United States Patent [19]

Boyden

[11] 4,023,665

[45] May 17, 1977

[54] POWER DRIVEN TYPEWRITER

[76] Inventor: Robert E. Boyden, 5040 Sereno Drive, Temple City, Calif. 91006

[22] Filed: May 19, 1975

[21] Appl. No.: 578,986

Related U.S. Application Data

[63] Continuation of Ser. No. 773,145, Nov. 4, 1968, abandoned.

[52] U.S. Cl. ..... 197/55; 197/18

[51] Int. Cl.² ..... B41J 1/32

[58] Field of Search ..... 197/18, 49, 52, 55, 197/176, 53, 16, 17, 51; 178/23, 30, 34, 33

[56] References Cited

UNITED STATES PATENTS

| | | | |
|---|---|---|---|
| 2,044,550 | 6/1936 | Teissedre | 197/55 |
| 2,127,507 | 8/1938 | Fuchs | 197/53 |
| 2,193,970 | 3/1940 | Krum et al. | 197/53 |
| 2,879,876 | 3/1959 | Palmer et al. | 197/16 |
| 2,919,002 | 12/1959 | Palmer | 197/16 |
| 2,951,439 | 9/1960 | Stutz et al. | 197/55 |
| 2,978,086 | 4/1961 | Hickerson | 197/16 |
| 3,168,182 | 2/1965 | Bernard et al. | 197/55 |
| 3,225,884 | 12/1965 | Krauss et al. | 197/17 |
| 3,228,510 | 1/1966 | Howard | 197/49 |
| 3,256,969 | 6/1966 | Bretti | 197/49 |
| 3,291,041 | 12/1966 | Burchfield et al. | 197/18 X |
| 3,302,764 | 2/1967 | Hickerson | 197/16 |
| 3,307,672 | 3/1967 | Young | 197/53 X |
| 3,352,398 | 11/1967 | Crutcher et al. | 197/16 |
| 3,362,517 | 1/1968 | Ryan et al. | 197/18 |
| 3,405,794 | 10/1968 | Means | 197/55 |
| 3,422,945 | 1/1969 | Bethune | 197/53 X |
| 3,442,365 | 5/1969 | Ragland et al. | 197/53 |

*Primary Examiner*—Ralph T. Rader
*Attorney, Agent, or Firm*—Finnegan, Henderson, Farabow & Garrett

[57] ABSTRACT

A typewriter comprising a shiftable carrier supporting a rotatable type drum having a plurality of circumferentially extending rows of type characters thereon. Typing keys, when depressed, condition actuators and cause engagement of a power driven cyclic action clutch which drives a power bail to operate a conditioned actuator to rotate the type drum from any position it may be in to a new position to align a type character corresponding to the key depressed with the printing point. Certain of the keys, when depressed, position stops to limit axial movement of the type drum by the action clutch to align an appropriate one of the rows of type characters with the printing point. The action clutch also actuates a centralizer to accurately align the type drum prior to printing and, in addition, causes printing. A cyclic carrier shift clutch is engageable by the action clutch and by certain carrier shift control keys.

12 Claims, 19 Drawing Figures

RETURN
INDEX
BACK SPACE

POWER DRIVEN TYPEWRITER

This is a continuation of application Ser. No. 773,145, filed Nov. 4, 1968, now abandoned.

This invention relates to typewriters and has particular reference to a power driven typewriter having a movable type member containing a font of type thereon which is movable coordinately under control of different type keys to locate a selected type character at a printing point.

A principal object of the present invention is to provide a simple and power driven means for both rotatably and axially positioning a type drum to locate a selected type character at a printing point.

Another object is to provide a key controlled, power driven, cyclically operable clutch means for both selectively positioned a type drum to print a desired type character and to effect character spacing of the drum.

Another object is to rotate a type drum under power from any position directly to a new position to locate a selected type character at a printing point.

Another object is to provide power means for preventing concurrent depression of any two or more type keys.

Another object is to enable continued serial typing by a single type character by maintaining a corresponding type key depressed beyond a predetermined position.

Another object is to enable continued stepping of a type carriage by maintaining a carrier shift control key depressed beyond a predetermined position.

Another object is to reduce the number of operating parts in a power driven typewriter.

The manner in which the above and other objects of the invention are accomplished will be readily understood on reference to the following specification when read in conjunction with the accompanying drawings, wherein.

Figures 1, 3:
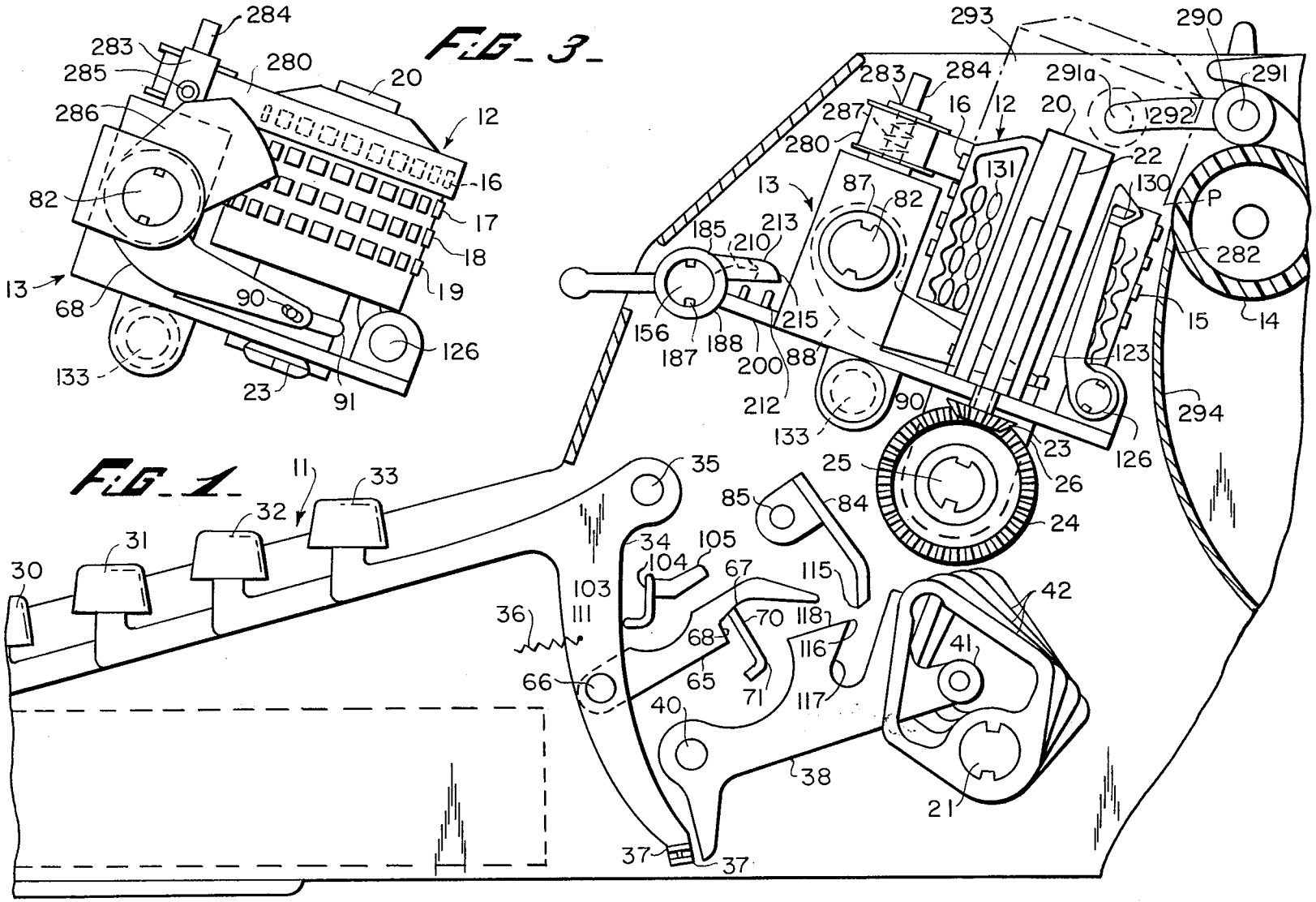
FIG. 1 is a longitudinal sectional view through a typewriter embodying a preferred form of the present invention.
FIG. 3 is a sectional view taken substantially along the line 3—3 of FIG. 2, illustrating the type drum and carrier.

Referring to the drawings, the typewriter comprises generally a keyboard 11, a type drum 12, a type drum carrier 13, and a platen 14 over which a sheet of paper, i.e. 15, is guided. The type drum has four rows 16, 17, 18, and 19 of type characters therearound, each row including 22 equally spaced type characters, the characters in all rows being vertically aligned with each other.

The type drum 12 is slideably keyed on a substantially vertical shaft 20 which is rotatably mounted on a post 21 integral with the body of the carrier 13. A spindle 22 is secured to the shaft 20 and has a bevel gear 23 thereon which meshes with a similar gear 24 slideably keyed on a shaft 25. Brackets 26 depending from the carrier 13 on opposite sides of gear 24 maintain the gears 23 and 24 in mesh during movement of the carrier along the shaft 25.

Figures 5, 5A, 6, 7, 8:
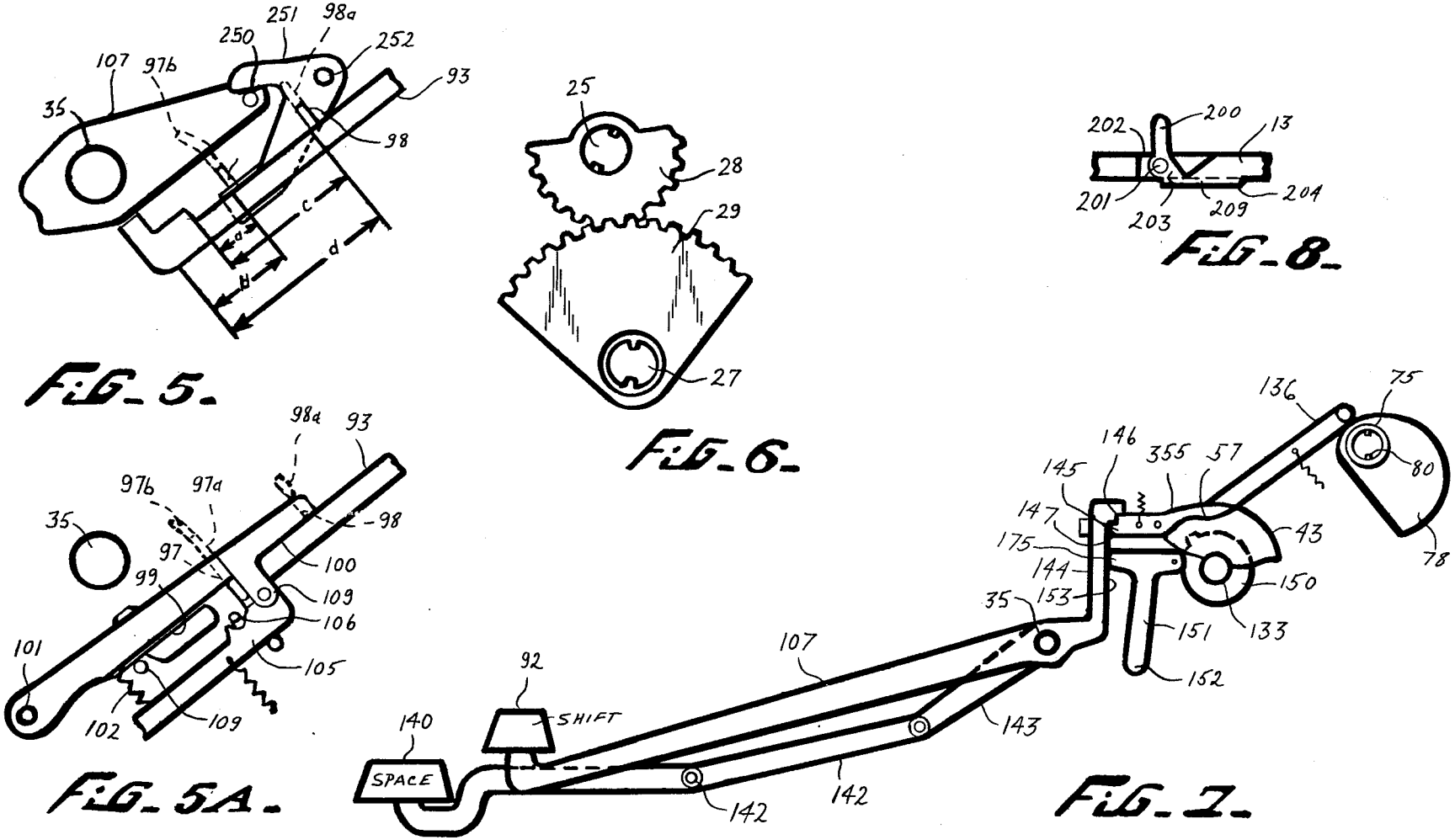
FIG. 5 is a fragmentary sectional view of part of the controls for raising the type drum to different positions.
FIG. 5A is a fragmentary sectional view similar to FIG. 5 but taken in a different plane.
FIG. 6 is a sectional view illustrating part of the drive for rotating the type drum.
FIG. 7 is a sectional view illustrating the space and shift controls.
FIG. 8 is a view taken substantially along the line 8—8 of FIG. 2.

Gear 24 is angularly adjusted to rotate the type drum by a second shaft 27 through a pair of meshing gear sectors 28 and 29 (FIG. 6).

For the purpose of selectively positioning the type drum 12 to locate any of the type characters thereon in vertical alignment with a printing point P opposite the platen, four rows 30, 31, 32 and 33 of depressible type keys are provided. Each of said keys is mounted on a respective key lever 34 pivoted on a stationary shaft 35 and urged clockwise to their illustrated raised positions by tension springs 36. Each key lever has an ear 37 overlying an actuator or cam lever 38 pivotally supported at 40 and carrying a camming roller 41 operable within a respective box cam 42 fixed on the shaft 27.

There are 44 type keys and 22 cam levers 38. Accordingly, the ears 37 of two type key levers 34 lie in front of each cam lever.

The various box cams 42 are located in a helical series about the shaft 27 so that when one of the keys is depressed and its cam lever 38 raised, as will be described later, the respective cam roller 41 will be forced toward the apex of the cam opening in its respective cam, thereby rotating the type drum from any position in which it was previously located to a new position wherein a type character corresponding to the key depressed is vertically aligned with the printing point P.

Two power driven clutches, a space clutch 43 and an action clutch 44 (FIGS. 5, 11 and 12) are provided to perform certain functions under control of certain of the typing and control keys. For example, the space clutch 43 is effective to advance the carriage 13 during character spacing, back spacing, return and tab functions, whereas the action clutch 44 performs such functions as raising the type drum to locate an appropriate one of the type character rows 16 to 19 at the printing point P, to cause operation of the space clutch, and to effect printing.

Figures 9, 10, 11, 12, 13:
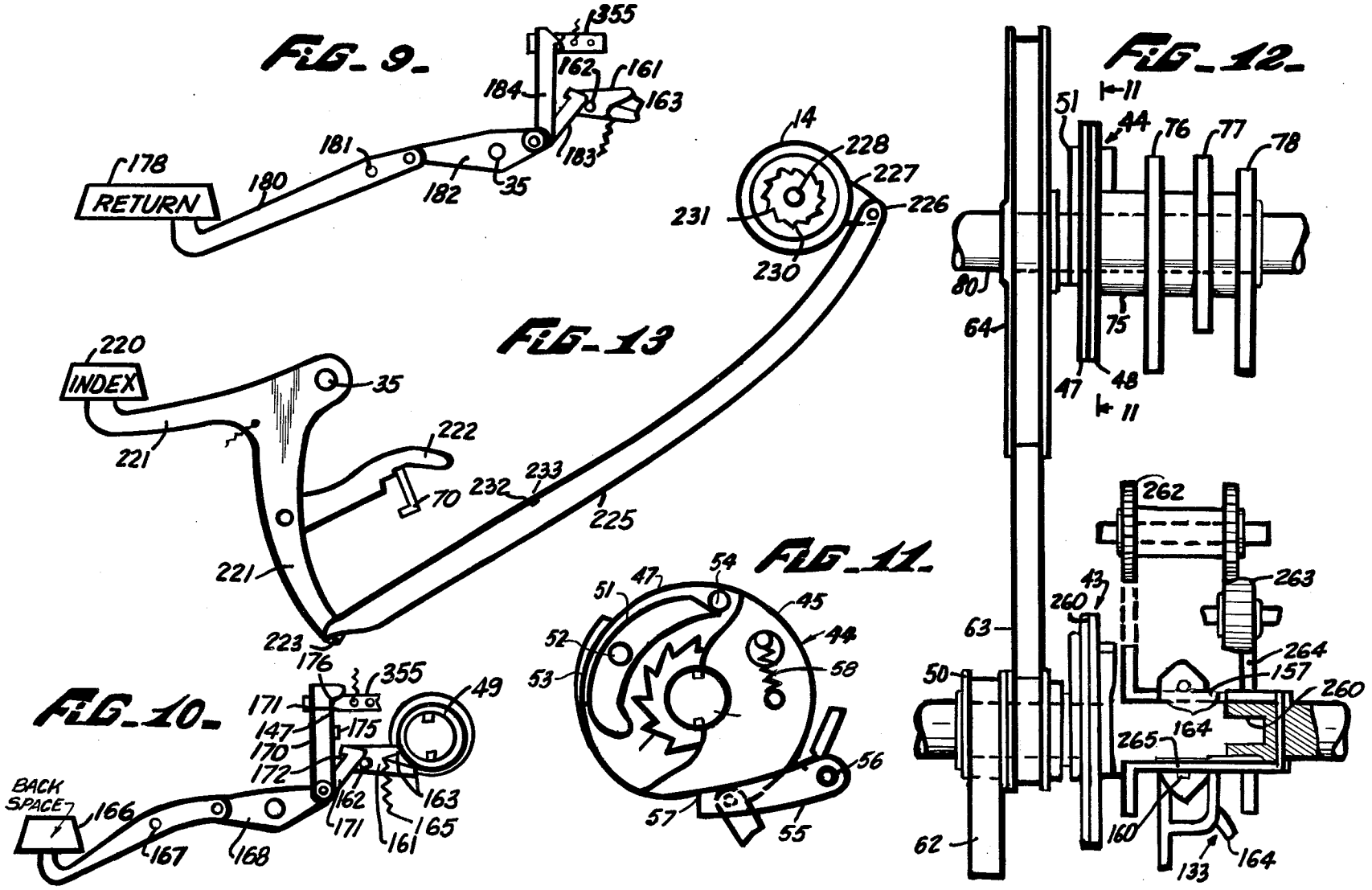
FIG. 9 is a sectional view illustrating part of the carrier return controls.
FIG. 10 is a sectional view illustrating the carrier backspace controls.
FIG. 11 is a sectional view illustrating one of the clutches and is taken along the line 11—11 of FIG. 10.
FIG. 12 is a transverse sectional view illustrating the clutch drive and reverse mechanisms.
FIG. 13 is a sectional view illustrating the platen indexing controls.

As shown in FIGS. 11 and 12, the action clutch 44 comprises a clutch disc 45 attached to a driven hub 75 rotatably mounted on a shaft 80 and a second clutch disc 47 freely mounted on the hub. A ratchet wheel 48 is also freely mounted on the shaft 80 and forms part of a pulley 64 also freely rotatable on the shaft. A pawl 51 is pivotally supported at 52 on the clutch plate 45 and is urged toward engagement with the ratchet wheel 48 by a leaf spring 53 but is normally held out of engagement therewith by a pin 54 carried by the clutch plate 47 when shoulders 57 on both plates are engaged by a clutch control dog 55. The latter is pivotally supported at 56 and is normally spring held in its illustrated clutch disengaging position. Upon downward rocking of the dog 55 to a clutch engaging position, a spring 58 extending between studs on the clutch plates will be effective to rock the clutch plate 47 clockwise sufficiently to permit the pawl 51 to engage the rotating ratchet wheel 48 and thereby cause a complete revolution of the hub 75.

Figure 4:
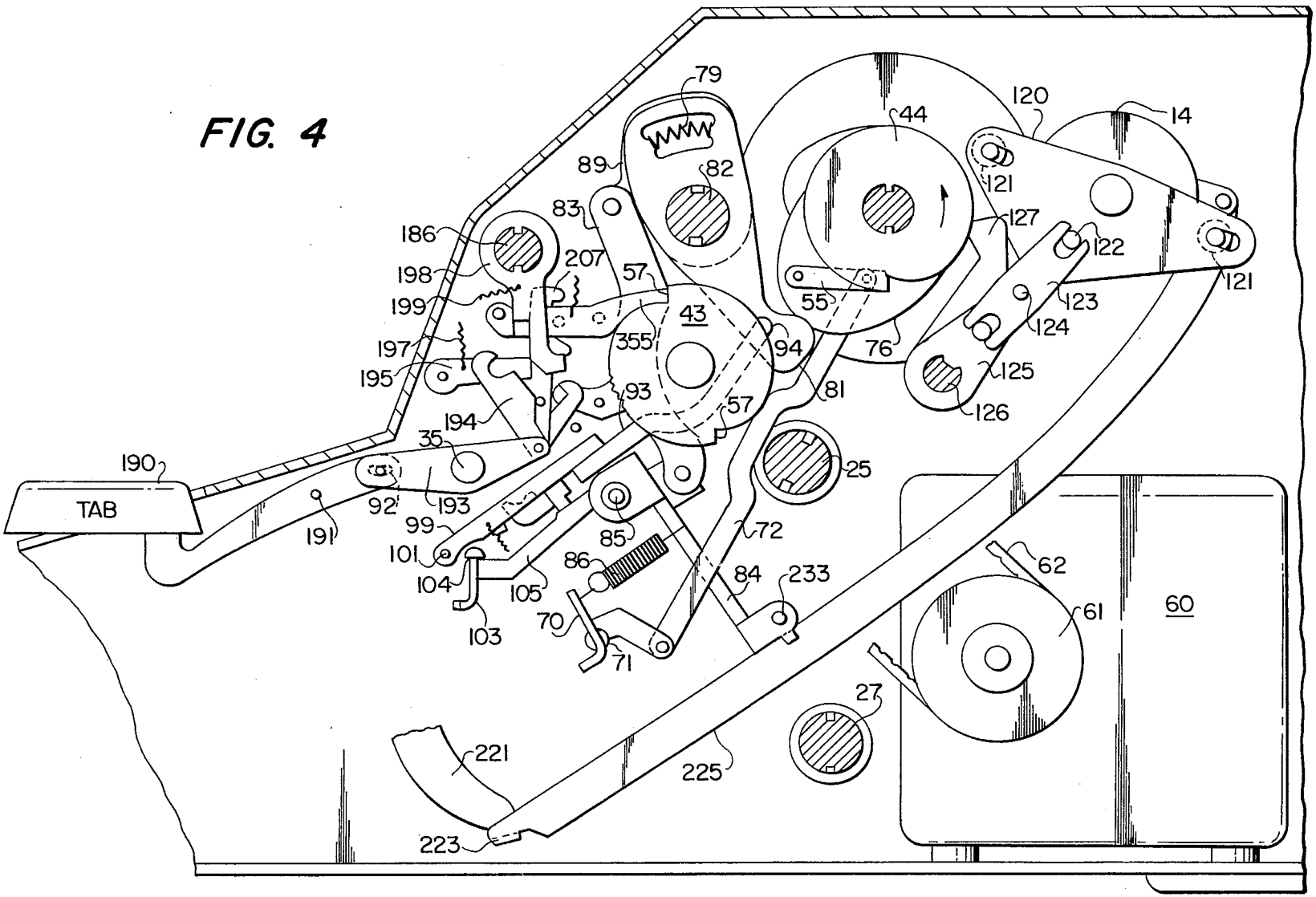
FIG. 4 is a sectional view illustrating the clutches and certain of the controls.

Both clutches 43 and 44 are similar in construction and the ratchet wheels of both are continuously driven. For this purpose, a motor 60 (FIG. 4) is provided, having an output pulley 61 which is connected by a cog belt 62 to a pulley 50 rotatably mounted on a shaft 49. The latter pulley is connected by a second cog belt 63 to the above noted pulley 64.

Depression of any of the type keys is effective to engage the action clutch 44 and for this purpose each key lever 34 has an interposer 65 pivoted thereto at 66. Two spaced shoulders, a primary shoulder 67 and a secondary shoulder 68, are formed on each interposer, the former normally lying in front of a bail 70 fulcrummed at 71 and connected by a link 72 to the clutch dog 55 of the action clutch 44. Thus, as the interposer is moved rearwardly its shoulder 67 will rock bail 70 to move the clutch dog 55 to clutch engaging position.

As seen in FIG. 12, the clutch driven hub 75 has cams 76, 77, and 78 mounted thereon. In the full cycle position of the action clutch 44, as illustrated, the high point of cam 76 (see also FIG. 4) is engaged by a cam follower 81 pivoted on a shaft 82 and yieldably connected by compression spring 79 to an arm 89 keyed on rock shaft 82 and connected by a link 83 to a combined actuating and blocking bail 84 which is fulcrummed at 85 and urged clockwise by a tension spring 86 whereby to urge the cam follower 81 to follow the cam 76.

For the purpose of differentially raising the type drum 12 to different levels so as to align a particular row of type characters with the printing point P, a bushing 87 is rotatably mounted in the body of the carrier 13 and is slideably keyed on the shaft 82. Arms 88 are integral with opposite ends of the bushing and such arms are connected through pin and slot connections 90 (FIG. 1) to a ring 91 rotatably mounted in a groove formed in the hub of the type drum.

Means are provided to differentially control the level to which the type drum is raised, depending upon the particular type keys depressed and on whether or not a shift key 92 (FIG. 7) has been depressed. For this purpose, a hook member 93 (FIGS. 4, 5 and 5A) is pivotally connected at 94 to the cam follower 81 and is provided with two spaced shoulders 95 and 96, each of which is adapted to limit against either of two ears 97 and 98 on blocking levers 99 and 100, respectively. Both levers are pivotally supported at 101 and are independently urged downwardly by springs 102 into their illustrated positions where they limit against a stop stud 109. If the blocking levers 99 and 100 were left in their illustrated positions during a cycle of the action clutch 44, the cam follower 81 and shaft 82 would be allowed to rock counterclockwise until the shoulder 95 moved through one increment *a* until it struck the ear 97, resulting in the type drum 12 being raised from a lowered position to align the uppermost row 16 of type characters with the printing point P.

Depression of any of the type keys in the two rearmost rows 32 and 33 is effective to raise the type drum to align the type character row 16 with the printing point but depression of a type key in any of the two foremost rows 30 and 31 is effective to raise the type drum to align the type character row 17 with the printing point. For this purpose, a bail 103 extends across the machine and is pivoted at 104. The bail carries an arm 105 (FIGS. 1 and 5A) which underlies pins 106 and 109 on the blocking levers 99 and 100, respectively.

The bail 103 is cut out at 111 opposite those levers 34 carrying keys in the rows 32 and 33 so that depression of any such keys will not rock the bail. However, upon depression of any of the keys in the remaining rows 30 and 31 will rock the bail 103 counterclockwise to thus raise the blocking levers 99 and 100, positioning their blocking ears in the dotted line positions 97*a* and 98*a*. This will allow the hook 93 to advance two increments *b* until the shoulder 96 strikes blocking ear 97 in its new position 97*a*, thereby permitting the type drum to raise until the type character row 17 is aligned with the printing point.

When the shift key 92 is depressed to select capital letter characters for printing, its support lever 107 (FIGS. 5 and 7) will rock about shaft 35 and a pin 250 thereon will rock a lever 251 about its pivot 252 causing an underlying arm thereon to raise the blocking lever 99 to position its ear 97 in the dotted line position 97*b*, above the path of both hook shoulders 95 and 96. Accordingly, upon depression of a type key in one of the rows 32 and 33 concurrently with depression of the shift key, the lever 100 will be allowed to remain in its lower position and the hook 93 will be permitted to move rearwardly three increments *c* until the shoulder 95 thereon limits against the ear 98, at which time the type character row 18 will be aligned with the printing point P.

When the shift key 92 is held depressed and a type key in one of the rows 30 and 31 is depressed, the bail 103 will be rocked to raise the blocking lever 100, locating its ear 98 at 98*a* so that the hook 93 can advance four increments *d* wherein shoulder 96 will limit against ear 98 in its new position to align the lowermost type character rows 19 with the printing point.

In order to prevent depression of two type keys at substantially the same time, the bail 84 has a sharp edge 115 which normally lies directly opposite a similar corner 116 on each of the cam levers 38. Upon depression of any type key and consequent engagement of the action clutch 44, the bail will strike a surface 117 on the partly raised lever 38, thereby forcing the actuated lever through the remainder of its upward stroke. At the same time, the bail 84 will move over the top surfaces 118 of the remaining cam levers to prevent depression of any of the other keys until the current cycle has been completed. Also, the bail 84 picks up the rear end of the actuated interponent 65 to release the shoulder 67 from the clutch engaging bail 70 and thus normally limit the clutch to one cycle even though the key is held depressed. However, upon further depressing the type key against an added spring pressure, the shoulder 68 of the interponent may additionally rock the bail 70 to maintain the clutch 44 in operation through two or more successive cycles and thus repetitively print the same type character. It should be noted that the bail 84 will be effective to rock the interponent sufficiently to release the shoulder 68 from the bail 70.

Printing is effected by moving the platen 14 transversely forward slightly to strike the paper sheet 15 against a type character located at the printing point P. For this purpose, the platen is rotatably mounted at opposite ends in slide plates 120 (FIG. 4) having slots guided over stationary guide pins 121. Each plate 120 is coupled through a pin-and-slot connection 122 to a lever 123 fulcrummed at 124 and similarly coupled to an arm 125 fastened to a rock shaft 126. The latter also carries a cam follower arm 127 which follows the cam 77 (FIG. 12).

For the purpose of centralizing the type drum in any type printing position, a centralizer arm 128 is slideably keyed on the shaft 126 and is movable with the carrier 13. A centralizing head 130 on the centralizer is effective to engage any of a series of detent pockets 131 formed on the inner periphery of the type drum.

Figure 14:
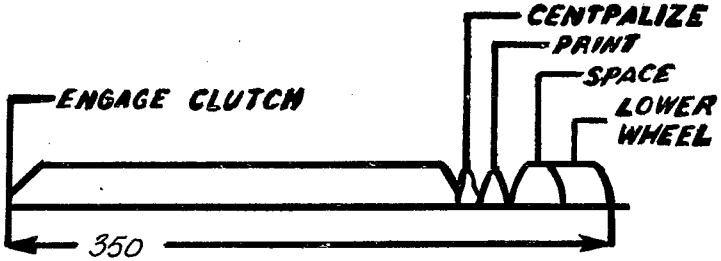
FIG. 14 is a basic timing diagram of the typewriter.

As shown in FIG. 14, after the type drum has been positioned, as described above, the centralizer engages a pocket 131 to accurately locate a type character opposite the printing point and shortly thereafter the platen is advanced to cause a printing impression.

An endless printing ribbon 280 (FIGS. 1 to 3) is provided to transfer an imprint from a selected type character to the paper. The ribbon is guided around a rectangular ribbon guide frame 281 having an opening 282 therein for transmitting an imprint from the type character to the paper at the printing point P. Brackets 283 extend from the ribbon frame and have bearings therein slideable over guide posts 284 mounted on the carrier 13 to guide the frame up and down. For the purpose of raising the ribbon to a position opposite the printing point P, rollers 285 are mounted on the ribbon frame brackets 283 and rest in engagement with cams 286 forming part of the aforementioned arms 88. Upon counterclockwise rocking of the shaft 82 to raise the type drum, the cams 286 raise the ribbon frame to its upper position.

The ribbon 280 is also guided over a pair of re-inking rollers 287 formed of ink-absorbing material whereby to continuously re-ink the ribbon as it is moved thereover.

Means (not shown) are provided for incrementally advancing one of the rollers 287 during each advancement of the carrier so as to likewise advance the ribbon.

Figure 2:
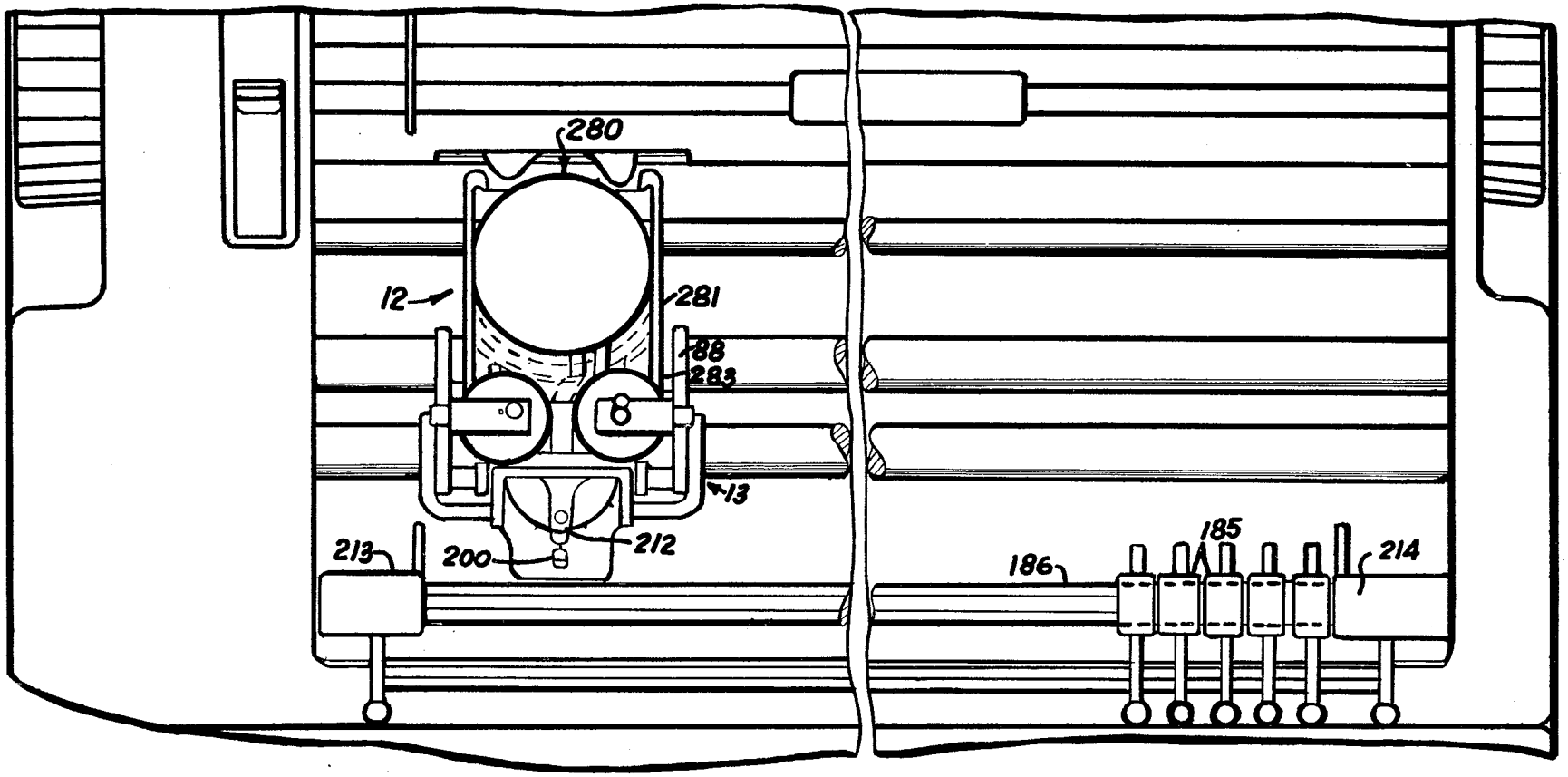
FIG. 2 is a plan view with parts broken away.

Means are provided for causing the type carrier 13 to shift one character space toward the right in FIG. 2 as an incident to each printing impression. For this purpose, the carrier is screw threaded on a screw shaft 133 (FIGS. 1, 3 and 12). The latter is connected to the driven side of the spacing clutch 43 through a reversing unit, generally indicated at 135, the construction of which will be described later.

As shown in FIGS. 7 and 12, the cam 78 driven by the action clutch 44 engages a cam follower 136 attached to the clutch dog 355 of the spacing clutch 43 to rock the clutch dog to clutch engaging position. Following a print operation, as indicated in FIG. 14, the spacing clutch is engaged to rotate the screw shaft 133 one-half revolution (there being two diametrically opposed stop shoulders 57 thereon) whereby to advance the carrier one character space to the right.

The space bar 140 (FIG.7) is also effective to cause character spacing of the carrier 13, and for this purpose, the space bar is mounted on levers 141 fulcrummed at 142 and pivotally connected to a lever 143 fulcrummed at 35 and pivotaly connected to a hook 144 having a pair of shoulders 145 and 146 thereon. Normally the shoulder 145 engages a pin 147 on the clutch dog 355 of the spacing clutch 43 so that depresion of the space bar will rock the clutch dog to cause engagement of the shift clutch.

For the purpose of normally restricting the clutch 43 to a single cycle even though the space bar 43 may be held depressed to a normal depth, a cam 150 is mounted on the screw shaft 133 and during each clutch cycle it rocks an interponent 151 about a pibotal support 152 to rockk the hook 144 against the action of a tension spring 153 and thus release the hook shoulder 145 from engagement wit the pin 147, permitting the clutch dog 355 to disengage the clutch at the completion of its cycle. However, if it is desired to cause repetitive spacing of the carrier 13, the space bar 140 is depressed further against added spring pressure causing the secon shoulder 146 thereon to engage the stud 147 and thus release the clutch dog 355 for two or more cycles of the clutch 43. During such additonal clutch cycles, the throw of clutch 150 is ineffective to release the shoulder 146 from pin 147.

Describing now the reversible drive connection of FIG. 12, the driven plate 260 of the shift clutch 43 is suitably attached to the shaft 49 which has a reduced diameter section freely journalled in bearing 260 formed in the screw shaft 133. A gear 261 is freely rotatable on the shaft 49 and meshes directly wit a doulbe idler gear 262, the latter meshing wit a pinion 263 which , in turn, meshes wit a gear 264 secured on the shaft 133. Accordingly, gears 261 and 254 always rotate in opposite directions A key 265 is slideable lengthwise in a keyway 156 formed in the shaft 49. A split using 157 surrounds the shaft 49 and has an outside diameter equal to that of the hub of hears 261 and 264. An anular double conically formed side member 158 is sideably mounted over the bushing 157 and hubs of the gears 151 and 154 and has a anular groove 160 therein by which it is coupled to the key 265.

The annular slide member 158 is engageable by a two-pronged shift member 161 (FIGS. 9,10, and 12) which is fulcrummmed on a frame pin 162.The two prongs 163 of member 161 are displaced angularly and laterally from each other an are selectively engageable with opposite conical surfaces of the member 158 whereby to shift the same axially over the bushing 157.

The inner end hub faces of the gears 261 and 264 each have a series of teeth 164 therearound alternatively engageable by opposite ends of the shown in FIGS. 9 and 10 by a tension spring 165 will sift the member 158 to the right in FIG. 12, thereby causing the key 265 to couple the clutch to gear 261, thereby driving the shaft 133 in a direction opposite to that of the clutch. However, upon counterclockwise rocking of the reverse lever 161 the member 158 will be shifted to the right, thereby directly connecting the shaft 133 to the clutch driven shaft 49.

Describing now the operaton of the carrier back space mechaism, a back space key 166 (FIG. 10) has its key lever fulcrummed at 167 and pivotally connected to a lever 168 fulcrummed on the shaft 35. The latter is pivotally connected to a hook 170 having a soulder 171 normaly overlying the pin 147 on the sift clutch control dog 355 (see also FIG. 7). A second hook 171 pivotaly connected to the lever 168 hooks over a pin 172 on the shift reverse lever 161. Accordingly, whe the back space key is depressed a normalamount, the reverse lever 161 sets the reverse mechanism 135 to drive the carriage to the left and the hook 170 rocks the clutch dog 355 to cause engagement of the shift clutch.

An ear 175 of interponent 151 extends behind the hook 170 and is thus effective t normall limit operaton of the sift clutch to one cycle. However, the hook 170 has a second shoulder 176 thereon effective to engage the stud 145 and thus maintain the clutch dog out of engagement to effect continuous backspacing of the carrier 13 by futher depreesion of the backspace key 166 in the same manner as is effected by the sift key 92.

Return of the carrier 13 t its leftmost position its effected by depression of areturn key 178 (FIG. 9). The latter is mounted on a lever 180 fulcrummed at 181 and pivotally connnected to a lever 182 fulcrummed on the shaft 35 and connected by a hook 183 to the reverse lever 161 and by a hook 184 to the clutch dog 355. Thus, the return dey operates in a manner similar to the backspace key 166 except that it will maintain the shift clutch in operation as long as it is held depresed. However, means, not shown, are effective to release the hook 184 from the clutch dog 355 when the carriage reaches its leftmost position.

Tabulating means are provided to control movement of the carrier 13 to any of different positions determined by settable tab stopss 185 (FIGS. 1 and 2.). such stops are slideably keyed to a rock shaft 186 and may be maually adjusted along the shaft to any of a plurality of positons, each corresponding to a character print position. Wire spring elements 187 are carried by the stops and are adapted to engage ay of a series of regularly spaced detent notches 188 in the shaft.

A tab key 190 (FIGS. 4) has its lever fulcrummed at 191 and pivotally connected at 192 to a lever 193 fulcrummed on the shaft 35 and connected by a hook 194 to a bocking member 195 pivotally supported at 196 and urged upwardly by spring 197 to normaly engage the side of a latch arm 198 fixed on the shaft 186 to thereby hold the shaft in its counterclockwise rocked position, against the action of a spring 199, wherein the tab stops 185 extend above the level of a pin 200 (FIGS. 2,3, and 8). The pin 200 is pivotally mounted at 201 in a opening 202 in the carrier 13 and has a laterally offset shoulder 203 which is normally held in engagement with one side of the opening by a leaf spring 209 fastened at 204 to the underside of the carrier.

A hook 207, similar to hook 184 of FIG. 9, is also pivotally connected to the tab key operated lever 193 so that depression of the tab key will rock clutch dog 355 counterclockwise to cause cycling of the shift clutch 43. At such time, spring 199 will rock arm 198 clockwise to latch the clutch dog 355 under a soulder 270 of the latch arm so as to cause continued cycling of the shift clutch to move the carrier 13 to the right. Similar clockwise rocking of the shaft 186 will locate the tab stops 185 in the path of pin 200. Each of the tab stops 185 has a camming surface 210 formed thereon so that upon engagement thereof by the pin 200 the tab stop, and therefore shaft 186, will be cammed counterclockwise to likewise rock the arm 198, thereby releasng the space clutch dog 355 to disengage the clutch.

A second pin 212 is rigidly mounted on the carrier 13. The latter pin is spaced to miss the tab stops 185 but is effective to enngage one or the other of a pair of longer margin stops 213 and 214 adjustable along the shaft 186 in the manner similar to the tab stops 185. Camming surfaces 215 on the margin stops 213 and 214 enable the pin 212 to rock the margin stops and thus disengage the shift clutch in the same manner as the tab stops function.

An index key 220 is provided to line space the paper 15. For this purpose, the index key is mounted on a lever 221, similar to the type key levers 34. The lever 221 is fulcrummed on shaft 35 and carries an interponent 22 similar to interponents 65 and engageable with the aforementioned action clutch-engaging bail 70. The lever 221 has an ear 223 engageable with the camming surface 224 on a link 225 pivotally connected at 226 to an arm 227 journaled on the shaft 228 which rotatably supports the platen 14. A pawl 230 carried by arm 227 is spring pressed against a ratchet wheel 231 on the platen.

Upon depression of the index key, the intermediate portion of the link 225 is raised to move a notch 232 therein into coupling engagement with a pin 233 (see also FIG. 4) formed on an extenson of the bail 84. Accordingly, upon cycling of the action clutch, the bai 84 will be rocked clockwise, pulling the link 225 downwardly and to the left, causing pawl 230 to incrementally advance the platen. Suitable means, not shown, are provided for selectively controlling the extent of line spacing movement during each actuation of arm 227 by the link 225.

A pressure roller 290 is provided to maintain the paper in frictional engagement with the platen 14. The pressure roller is rotatably mounted on a shaft 291 which is movable transversely along guide slots, 292 in side frames, i.e. 293, to an open throat position shown by dotted lines 29la, permitting the paper to be front fed into position. An arcuate paper guide pa 294 is located below the platen to receive and guide the lower end of the paper.

It will be noted that the type drum 12 may be readily removed for replacement or otherwise by merely springing the arms 88 apart and withdrawing the drum axially from the shaft 20.

Figure 15:
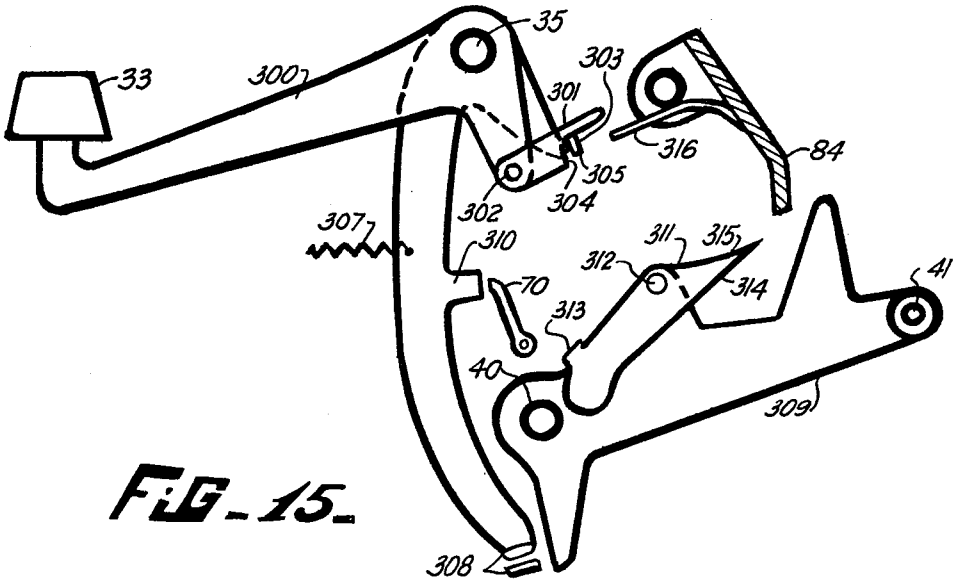
FIG. 15 is a sectional view of a modified form of the invention.

FIG. 15 illustrates a modified form of the invention in which each of the type keys 33 is mounted on a respective lever 300 fulcrummed on the rod 35. An interponent 301 is pivotaly connected to the lever at 302 and has a pair of shoulders 303 and 304, the former normaly enngaging an ear 305 on a arm 306 also pivoted on the rod 35. Thus, upon depression of any type key 33, its interponent 301 will rock its arm 306 against the action of a tension spring 307, causing an ear 308 thereon to rock an actuator 309 whose action is somewhat similar to that of 38. Also, a projection 310 on the arm 306 will rock the clutch control bail 70, causing engagement of the action clutch 44 to rock the actuator bail 84 clockwise. A pawl 311 is pivotally supported on each actuator 309 at 312 and has an ear 313 overlapping such actuator. Accordingly, bail 84 will engage the surface 314 of the partially raised actuator to raise the same through the remainder of its stroke and thus effect rotation of the type drum to a new position in the manner described heretofore. The bail will pass over the upper surface 315 of each of the remaining pawls 311, thus preventing actuation of the respective actuators. However, if two keys are depressed, one slightly ahead of the other, the leading depressed key partially raises its actuator 309 in the usual manner and the bail 84 will be rocked clockwise to cam such actuator through the remainder of its stroke. The actuator 309 associated wit the lagging depressed key will also be partialy raised by its key but the bail 84 will at such time be in blocking relation relative to the upper surface 315 of its pawl, thereby causing the pawl to rock sightly about is pivot 312. During such cycle, an extenson 316 on bal 84 will engage the interponent 301 to release the soulder 303 from engagemennt wit ear 305, permitting the arm 306 of the leading depressed key to be returned. Now, as the arm 306 and actuator 309 associated with the leading depressed dey are being returned to their normal positions during the latter part of the cycle, the bail 84 will also return to release pawl 311 from its rocked position. Thereafter, since the lagging depressed key will now effect a second cycle of the action clutch, the bail 84 will again advance to engage the undersurface 314 of the pawl 311 associated with such lagging depressed key to raise its actuator 309 through a camming stroke.

Figure 16:
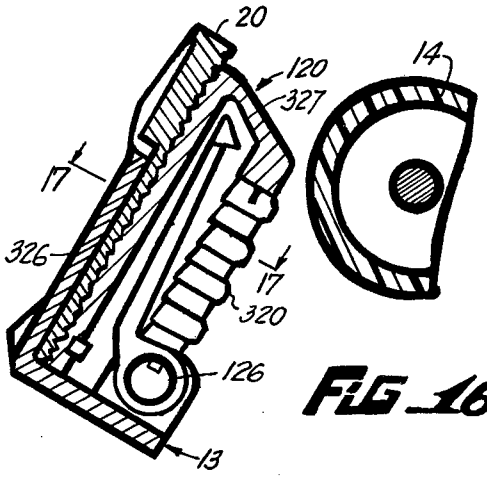
FIG. 16 is a fragmentary sectional view of another modified form of the invention.
Figure 17:
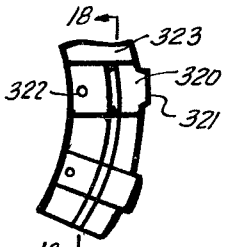
FIG. 17 is a sectional view taken along line 17—17 of FIG. 16.
Figure 18:
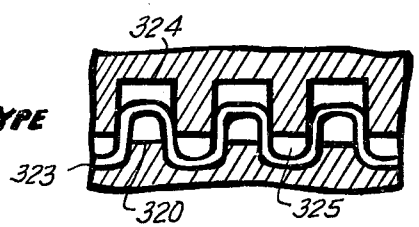
FIG. 18 is a sectional view taken along line 18—18 of FIG. 17.

FIGS. 16 to 18 illustrate another modified form of the invention in which the platen 14 is rotatably mounted in the framing of the typewriter and thus is not bodily moved to effect printing. In this case, a type drum 12a is slideably keyed on the shaft 20 and carries in each type character location, a slug 320 having a type character 321 formed on its outer end and a detent pocket 322 formed on its inner end. Each slug 320 is slideable endwise in a bearing formed in the body of the type drum and such slugs in each row are normally held in their illustated retracted positions by a wire spring 323 which is formed as shown in FIG. 18. The spring extends through transverse slots 324 in the type slugs and is bent to extend into slots 325 formed in the body of the type drum.

A combined centralizer and hammer 326, similar to centralizer 128 of FIG. 1, is slideably keyed on shaft 126 to move with the carrier 13. Thus, as the hammer 326 is rocked clockwise, its head 327 will first engage the sides of a pocket 322 in the selected type character to centralize the drum, following which the hammer will advance the slug to transfer an imprint of the type character thereon.

I claim:

1. A typewriter comprising:

a type member having a plurality of type characters thereon, selectively operable type character selection devices, power means including a first cyclically operable clutch controlled by any of said selecting devices for moving said type member to present a corresponding one of said type characters at a printing location and for causing an imprint of said last mentioned type character, power means including a second cyclically operable clutch for spacing said type member from one type character printing position to another, and a reversible drive unit driven by said second clutch, means operable by said first clutch for causing engagement of said second clutch, means normally causing said drive unit to space said type member in one direction upon engagement of said second clutch, a depressible control key, means responsive to depression of said control key for setting said drive unit to space said type member in the opposite direction, and means responsive to depression of said control key for causing engagement of said second clutch.

2. A typewriter comprising:

power means including a cyclic clutch;

a clutch control member, means for moving said clutch control member to clutch engaging position, a carriage, a type member supported by said carriage, means operable by said clutch upon engagement thereof for shifting said carriage, a rockable shaft extending parallel to the direction of movement of said carriage, latch means operatively connected to said shaft and adapted to latch said clutch control member in clutch engaging position, a tab stop control member settable in any of different positions along said shaft, and means on said carriage engageable with said tab stop control member and effective to rock said shaft whereby to cause said latch means to release said clutch control member.

3. A typewriter according to claim 2 comprising a margin control member on said shaft and means on said carriage other than said last mentioned means engageable with said margin stop control member and effective to rock said shaft whereby to release said clutch control member

4. A typewriter comprising:

a type member, a depressible key, power means including a cyclically operable clutch for causing printing by said type member, an interponent, a pivotal connection between said interponent and said key, said interponent having a primary surface and a secondary surface thereon, said primary surface being located at a greater distance from said pivotal connection than said secondary surface, a control member engageable by said primary surface upon depression of said key to a predetermined position for causing engagement of said clutch, and means operable by said clutch during the cycle thereof for releasing said primary surface from control member, said releasing means being effective to swing said interponent sufficiently about said pivotal connection to release said primary surface from said control member and to enable said secondary surface to engage said control member upon depression of said key beyond a predetermined position.

5. A typewriter comprising:

a shaft, a carriage movable along the length of said shaft, a type drum having a plurality of rows of type characters thereon, means on said carriage supporting said drum for rotation and axial movement, an actuating device slideably keyed on said shaft and movable with said carriage, said actuating device being operatively connected to said drum, a plurality of keys, means controlled by different ones of said keys upon depression thereof for rocking said shaft different amounts whereby to align different ones of said rows with a printing point, a second shaft parallel to said first shaft, a gear slideably keyed on said second shaft and movable with said carriage, a second gear meshing with said first gear and operatively connected with said type drum, means controlled by different ones of said keys upon depression thereof for rocking said second shaft different amounts whereby to position different ones of said type characters at said printing point, a third shaft parallel to said first two mentioned shafts, a centralizer member slideably keyed on said third shaft and movable with said carriage, said centralizer member being effective to centralize said drum in an axial direction and in a direction about said axis of rotation thereof, and means controlled by any of said keys upon depression thereof for rocking said third shaft whereby to cause said centralizer member to centralize said drum.

6. A typewriter comprising:

a type member having a plurality of type characters thereon, a device operatively connected to said type member and movable to different positions to cause said type member to present different ones of said type characters to a printing position, a plurality of actuators advanceable through predetermined strokes to actuate said device to different ones of said positions, a plurality of depressible keys, means operable by each of said keys upon depression thereof to partially advance a respective one of said actuators through its said stroke, and a power oscillated member responsive to said depression of each of said keys for fully advancing a respective partially advanced one only of said actuators through the remainder of its said stroke.

7. A typewriter according to claim 6 wherein said member is effective upon advancement of a said actuator thereby to prevent advancement of the remaining said actuators by respective ones of said keys.

8. A typewriter according to claim 6 wherein said device comprises a plurality of elements, each engageable by a respective one of said actuators and movable from any position thereof to a position represented by the advanced one of said actuators.

9. A typewriter comprising:

a type member having a plurality of type characters thereon, a device operatively connected to said type member and movable to different positions to cause said type member to present different ones of said type characters to a printing position, a plurality of actuators advanceable through predetermined strokes to move said device to different ones of said positions, said device comprising a plurality of cam elements each engageable by a respective one of said actuators during advancement of a said actuator through its said stroke and movable from any of said positions to a position represented by said actuator, a plurality of depressible keys, a drive member movable through an actuating path and adapted to drive a said actuator positioned in said path through said predetermined stroke thereof, means responsive to depression of each of said keys to position its respective said actuator in said actuating path, and power means responsive to depression of any of said keys to cause said drive member to move through said actuating path.

10. A typewriter according to claim 9 wherein said drive member is effective to prevent movement of any of said actuators into said actuating path during movement of said drive member through said actuating path.

11. A typewriter according to claim 9 wherein said actuators are each engageable with one or another of a pair of converging cam surfaces on a respective one of said cams whereby to move said device from any of said positions to a position represented by a said actuator upon movement of said actuator through its said stroke.

12. A typewriter comprising a type member having a plurality of type characters thereon, a device operably connected to said type member and movable to different positions to cause said type member to present different ones of said type characters to a printing position, said device having a plurality of cam elements thereon, a plurality of actuators movable through actuating strokes and each effective to engage respective ones of said cam elements whereby to move said device to different ones of said positions, a plurality of depressible keys, and power means controlled by each of said keys upon depression thereof for causing a respective one of said actuators to move through its actuating stroke, each of said actuators being engageable with one or the other of said cam surfaces of a respective one of said cam elements whereby to move said device from any position thereof to a position representing a said depressed key.

* * * * *